US011896121B2

(12) United States Patent
Globerman

(10) Patent No.: US 11,896,121 B2
(45) Date of Patent: Feb. 13, 2024

(54) METHOD FOR MAKING SHELVES

(71) Applicant: Eyal Globerman, Petach Tiqwa (IL)

(72) Inventor: Eyal Globerman, Petach Tiqwa (IL)

( * ) Notice: Subject to any disclaimer, the term of this patent is extended or adjusted under 35 U.S.C. 154(b) by 0 days.

(21) Appl. No.: 17/525,980

(22) Filed: Nov. 15, 2021

(65) Prior Publication Data

US 2022/0071389 A1 Mar. 10, 2022

Related U.S. Application Data

(63) Continuation-in-part of application No. 16/586,986, filed on Sep. 29, 2019, now Pat. No. 11,219,308, which is a continuation of application No. PCT/IL2018/050379, filed on Mar. 29, 2018.

(60) Provisional application No. 62/533,685, filed on Jul. 18, 2017, provisional application No. 62/480,570, filed on Apr. 3, 2017.

(51) Int. Cl.

| | |
|---|---|
| ***A47B 57/40*** | (2006.01) |
| ***A47B 47/00*** | (2006.01) |
| ***A47B 47/02*** | (2006.01) |
| ***A47B 57/50*** | (2006.01) |

(52) U.S. Cl.

CPC ..... *A47B 57/406* (2013.01); *A47B 47/0083* (2013.01); *A47B 47/021* (2013.01); *A47B 57/50* (2013.01); *A47B 2230/0011* (2013.01)

(58) Field of Classification Search

CPC . A47B 2230/0011; A47B 57/06; A47B 57/16; A47B 57/18; A47B 57/20; A47B 57/22; A47B 57/26; A47B 57/30; A47B 57/40; A47B 57/50; A47B 57/402; A47B 57/404; A47B 57/406; A47B 57/408; A47B 47/02; A47B 47/021; A47B 47/028; A47B 47/0083

See application file for complete search history.

(56) References Cited

U.S. PATENT DOCUMENTS

| | | | |
|---|---|---|---|
| 1,401,041 | A | 12/1921 | Chipperfield |
| 3,045,834 | A | 7/1962 | Seiz |
| 3,127,995 | A | 4/1964 | Mosinski |
| 3,195,735 | A | 7/1965 | Jay |
| 3,414,224 | A | 12/1968 | Robilliard et al. |
| 3,565,264 | A | 2/1971 | Guiber |
| 4,064,996 | A | 12/1977 | Shillum |
| 4,074,812 | A | 2/1978 | Skubic et al. |

(Continued)

FOREIGN PATENT DOCUMENTS

| | | |
|---|---|---|
| CN | 105078005 A | 11/2015 |
| CN | 205568369 | 9/2016 |

(Continued)

*Primary Examiner* — Patrick D Hawn

(57) ABSTRACT

Beams and posts are disclosed. The beams and posts may be used for racks or shelving. The beams and posts may be formed by folding a sheet of metal. For example, the beams and posts may be non-volumous or hollow. Optionally, a portion of the wall of the beam or post is thickened, for example, by folding over the metal back and forth. Optionally, the thickened portion runs the length of the beam or post. In some embodiments, a fastener (e.g., a loop and/or hook) is formed in the thickened portion of the wall. For example, the fastener formed by punching out of the wall. Optionally, the fasteners are used to connect the posts to the beams.

15 Claims, 13 Drawing Sheets

(56) References Cited

U.S. PATENT DOCUMENTS

| | | | | | |
|---|---|---|---|---|---|
| 4,189,250 | A * | 2/1980 | Abbott | F16B 7/22 | 248/222.13 |
| 4,197,952 | A * | 4/1980 | De Fouw | A47B 47/021 | 211/208 |
| 4,406,374 | A | 9/1983 | Yedor | | |
| 4,549,665 | A | 10/1985 | Smitley | | |
| 4,711,183 | A | 12/1987 | Handler et al. | | |
| 4,805,787 | A * | 2/1989 | Gillotte | B42F 15/0082 | 211/208 |
| 5,295,446 | A | 3/1994 | Schafer | | |
| 5,350,074 | A * | 9/1994 | Rosenband | A47B 47/021 | 248/222.13 |
| 5,452,812 | A | 9/1995 | Niequist et al. | | |
| 5,735,221 | A | 4/1998 | Benayon | | |
| 5,975,318 | A | 11/1999 | Jay | | |
| 6,216,415 | B1 | 4/2001 | Briosi | | |
| 6,273,281 | B1 | 8/2001 | Berglund | | |
| 6,920,831 | B2 | 7/2005 | Lin | | |
| 7,337,729 | B2 | 3/2008 | Briosi | | |
| D683,983 | S | 6/2013 | Troyner et al. | | |
| 9,351,567 | B2 | 5/2016 | Go | | |
| 9,474,370 | B2 | 10/2016 | Troyner et al. | | |
| D777,480 | S | 1/2017 | Anderson | | |
| 10,299,589 | B1 | 5/2019 | Lai et al. | | |
| 2001/0013209 | A1* | 8/2001 | Waalkes | E04B 2/7433 | 248/245 |
| 2007/0062898 | A1* | 3/2007 | Choi | A47B 57/408 | 211/187 |
| 2012/0298600 | A1* | 11/2012 | McCarthy | B65G 1/02 | 211/49.1 |

FOREIGN PATENT DOCUMENTS

| | | | | |
|---|---|---|---|---|
| DE | 202006007660 | U1 * | 8/2006 | A47B 57/40 |
| EP | 0217144 | A2 | 4/1987 | |
| EP | 0486895 | A1 | 5/1992 | |
| EP | 0890330 | A1 | 1/1999 | |
| EP | 1854375 | A1 | 11/2007 | |
| FR | 2889654 | A1 | 2/2007 | |
| GB | 2157547 | A | 10/1985 | |

* cited by examiner

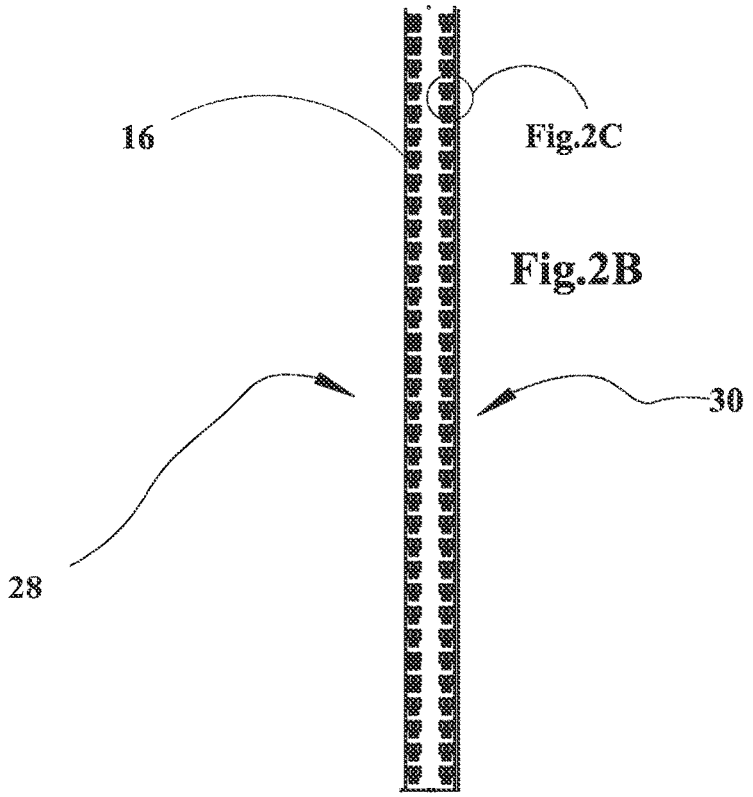
16
Fig.2C
Fig.2B
30
28
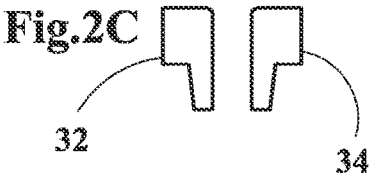
Fig.2C
32
34

Fig. 3A
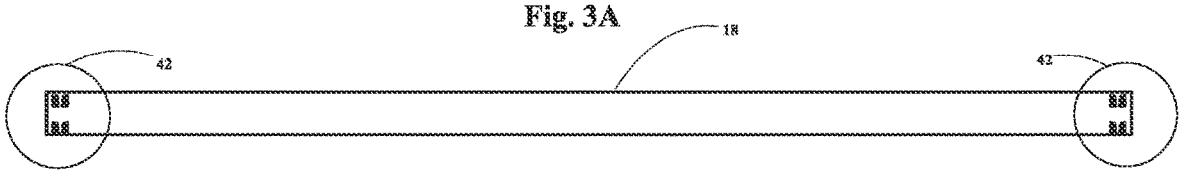
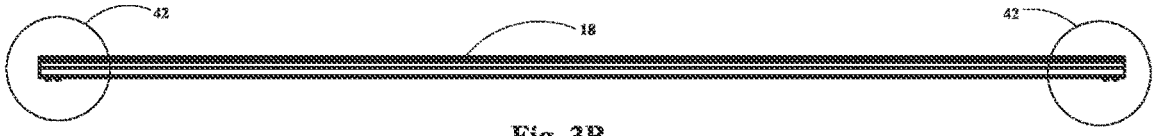
Fig. 3B

METHOD FOR MAKING SHELVES

CROSS-REFERENCE TO RELATED APPLICATIONS

This application is a Continuation In Part of U.S. application Ser. No. 16/586,986 filed 29 Sep. 2019 which is a continuation of International Patent Application no. PCT/IL2018/050379 filed 29 Mar. 2018, which claims benefit of U.S. Provisional Patent Application No. 62/480,570 filed 3 Apr. 2017 and of U.S. Provisional Patent Application No. 62/533,685 filed 18 Jul. 2017.

This application claims benefit of priority from of U.S. application Ser. No. 16/586,986 filed 29 Sep. 2019, International Patent Application no. PCT/IL2018/050379 filed 29 Mar. 2018, U.S. Provisional Patent Application No. 62/480,570 filed 3 Apr. 2017 and of U.S. Provisional Patent Application No. 62/533,685 filed 18 Jul. 2017.

The contents of the above applications are all incorporated by reference as if fully set forth herein in their entirety.

TECHNICAL FIELD

The present invention relates to metal shelving. The construction of pallet racks from components and specifically to joining upright posts with the horizontal beams to form a scaffolding unto which shelves are laid.

BACKGROUND ART

The use of pallet racks is common in warehouses and stores. Such appliances are designed to receive product bearing pallets typically from a forklift truck.

Typically, such racks are constructed from upright posts into which horizontal beams are connected. See for example European patent application EP 3042865A1.

SUMMARY

According to an aspect of some embodiments of the invention, there is provided a bar including: a thin wall; a thickened portion of the thin wall; a fastener formed in the thickened portion.

According to some embodiments of the invention, the thickened portion includes multiple layers of metal folded against each other.

According to some embodiments of the invention, the thickened portions run a length of the bar.

According to some embodiments of the invention, the bar has a plurality of the walls formed of a single sheet of folded metal.

According to some embodiments of the invention, the fasteners include at least one of a hook and a loop.

According to an aspect of some embodiments of the invention, there is provided a storage rack including: a bar including: a thin wall; a thickened portion of at the thin wall; a fastener formed in the thickened portion.

According to some embodiments of the invention, the thickened portion includes multiple layers of metal folded against each other.

According to some embodiments of the invention, the thickened portions run a length of the bar.

According to some embodiments of the invention, the bar has a form that is at least one of non-volumous and hollow.

According to some embodiments of the invention, the bar includes a plurality of the walls formed of a single sheet of folded metal.

According to some embodiments of the invention, the fasteners include at least one of a hook and a loop.

According to some embodiments of the invention, the bar is a horizontal beam of the rack and the fastener connects the bar to a post of the rack.

According to some embodiments of the invention, the bar is a post of the rack and the fastener connects the bar to a horizontal beam of the rack.

According to an aspect of some embodiments of the invention, there is provided a method of making a bar including: supplying a sheet of metal; folding over a portion of the sheet onto itself to form a thickened area of multiple layers; punching a fastener out of the portion; folding the sheet into a bar.

According to some embodiments of the invention, the folding over a portion includes folding back and forth to form a line of multilayered material along a full length of the sheet.

According to some embodiments of the invention, the folding the sheet into a bar include at least two folds to form a hollow bar.

According to some embodiments of the invention, the folding the sheet into a bar include at least two folds to form a hollow cylinder of non-circular cross section.

According to some embodiments of the invention, the folding the sheet into a bar include at least three folds to form a hollow cylinder of rectangular cross section.

According to some embodiments of the invention, the folding the sheet includes at least one fold of greater than 90 degrees to form a non-volumous bar.

According to some embodiments of the invention, the bar is a post of the rack and the fastener connects the bar to a horizontal beam of the rack.

According to some embodiments of the invention, the folding over and the folding the sheet are along parallel folds.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control.

In addition, the materials, methods, and examples are illustrative only and are not intended to be necessarily limiting.

BRIEF DESCRIPTION OF THE DRAWINGS

Some embodiments of the invention are herein described, by way of example only, with reference to the accompanying drawings. [IF IMAGES, REPHRASE] With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings:

FIG. 2B illustrates an upright post in accordance with the present invention featuring a double column of doublets of perforations.

FIG. 2C illustrates in detail the two perforations in each doublet.

FIG. 3A illustrates features of a broad side of a horizontal width forming beam.

FIG. 3B illustrates fasteners of a narrow side of a width forming beam.

FIG. 3C is an isometric view of a horizontal beam showing placement of the fasteners.

FIG. 3D is an enlarged isometric extremity of a horizontal width forming beam.

DESCRIPTION OF EMBODIMENTS

Figure 1:
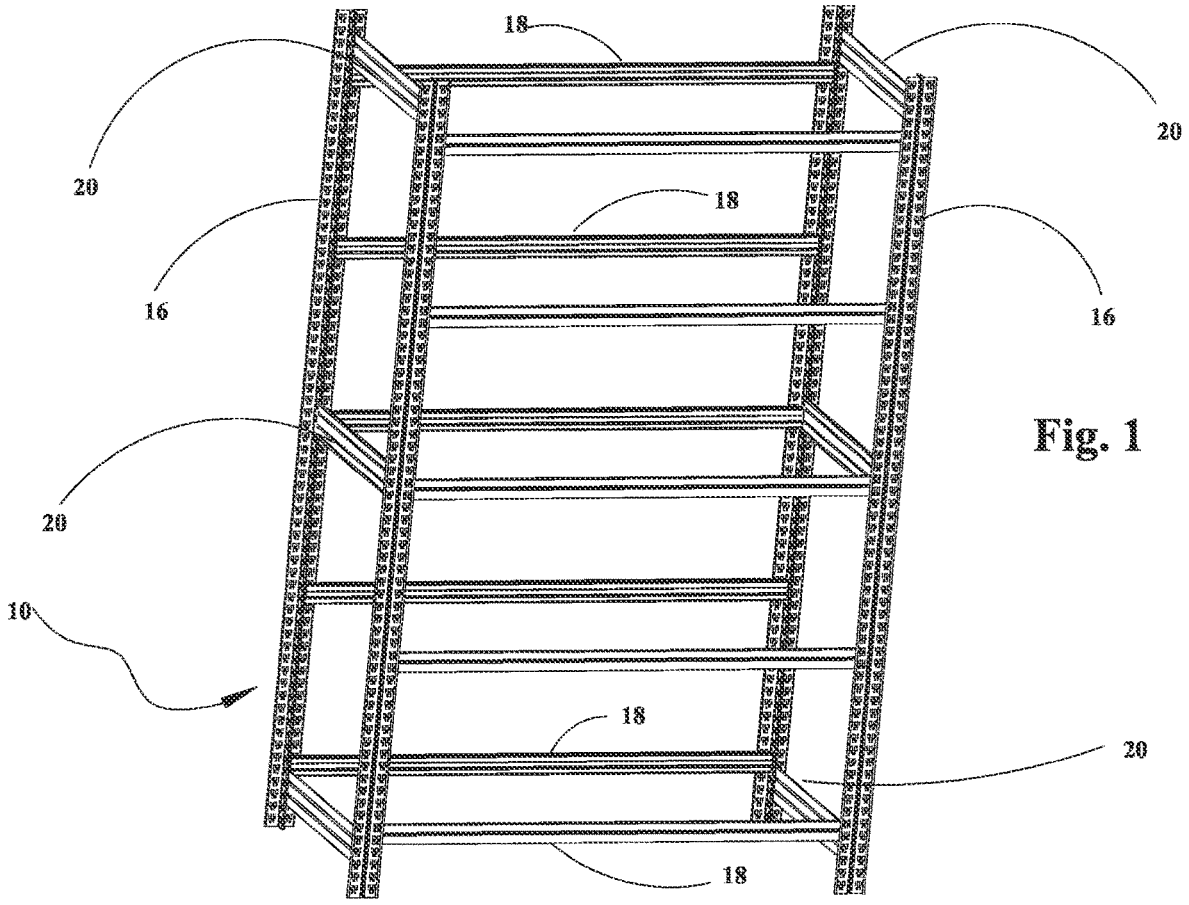
FIG. 1 is an isometric view of a four posted rack in accordance with the present invention.

Overview:

The present invention is implemented in the technical environment of storage racks, such as pallet racks and shelves. This invention, in some embodiments thereof, relates to structural elements and joining them together in a specific form whereby joining and supporting members of structures such as shelf racks, scaffolding, and the like. Particularly but not exclusively, an object of some embodiments of the invention to provide new and improved joints for connecting a supporting member and a supported member.

Exemplary Embodiments

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

The present invention, in some embodiments, provides a system along with a method for constructing racks, emphasizing sturdy joining aspects and strong posts and horizontal beams, whereby weight of the components is kept low. A general view of a simple rack 10 demonstrating some aspects of the invention is presented in FIG. 1. Rack 10 includes four upright posts 16 also referred to simply as "uprights" connected horizontally by two types of beams. Width forming beams 18 forming the width of the rack, and depth forming beams 20 that form the depth of rack 10.

A prominent aspect of the invention is the width joining system, to explain how this works, first the structural elements involved are described.

The Upright Posts

The posts shown in the figure are typically configure to form corners, however, there are upright posts configured otherwise.

Figure 2A:
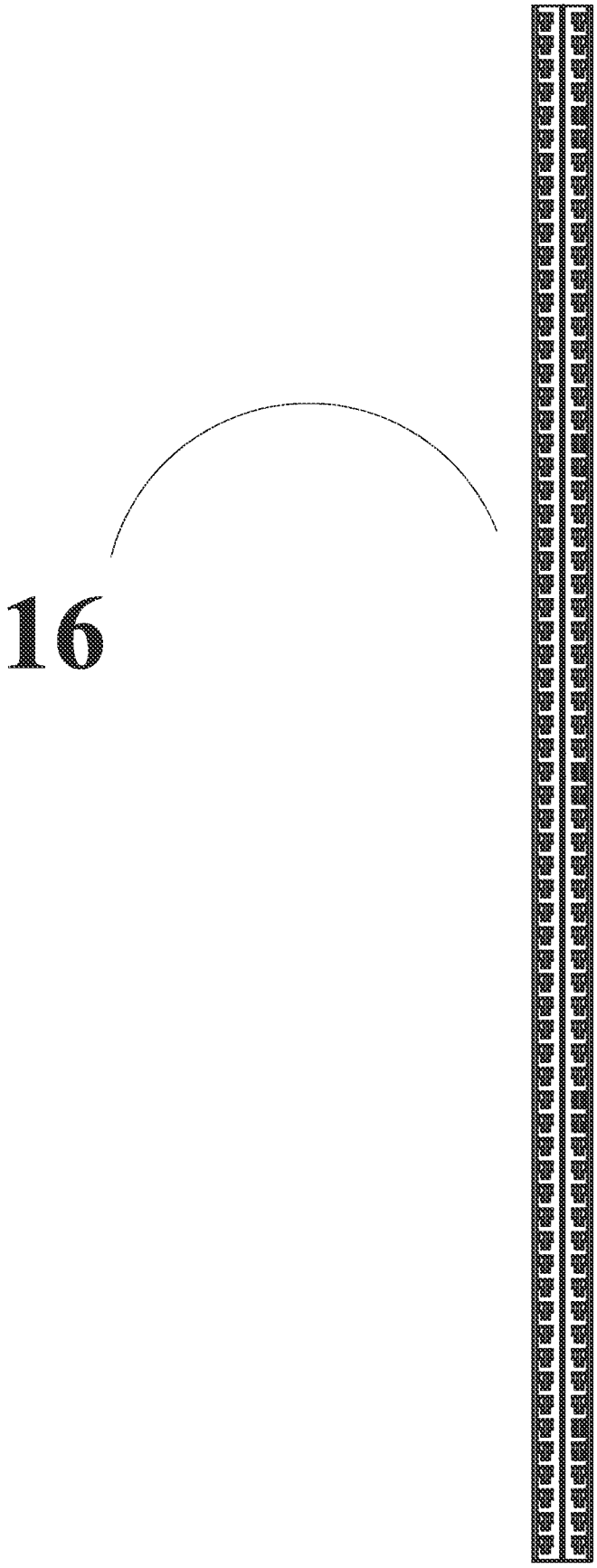
FIG. 2A illustrates a vertical (upright) post in accordance with the present invention, having a T profile.

As can be seen in FIG. 2A, upright post 16 features, having a T profile, such that two matching rows of vertically arranged columns of perforations as shown enlarged, with reference to FIG. 2B. Upright post 16 has the two flanks, left flank 28 and right flank 30. Each of the flanks features a column of doublets of through-perforations which will be related to as (gamma) perforations infra. As can be seen in FIG. 2C the two perforations in each doublet are axisymmetric with respect to each other such that perforation 32 (left) is identical but chorally opposed to perforation 34. Both perforations are cut-outs in the profile of the flanks 28 and 30 respectively. The perforations do not have any voluminous features.

The fasteners that fit in within these perforations do possess voluminous features and are therefore three dimensionally structured. The fasteners which fit in within the perforations are a part of the width forming beams. Before explaining how the joining works, important structural features of the horizontal beams are described.

The Horizontal Width Forming Beams

Figure 3E:
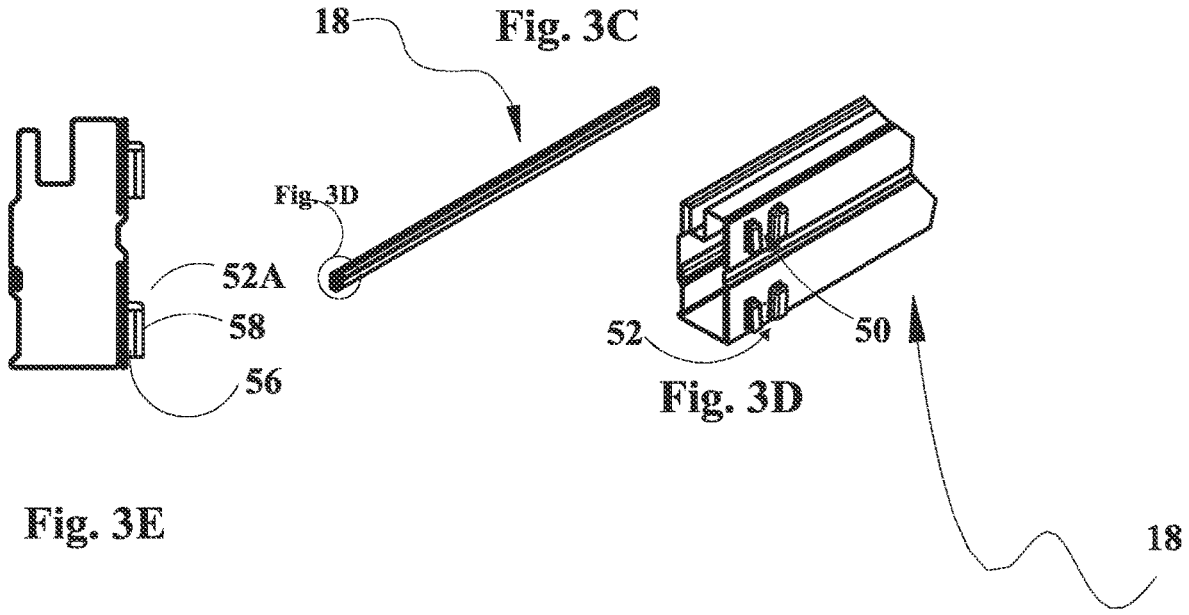
FIG. 3E is an enlarged extremity of a horizontal width forming beam showing fasteners with relation to profile.
Figure 3G:
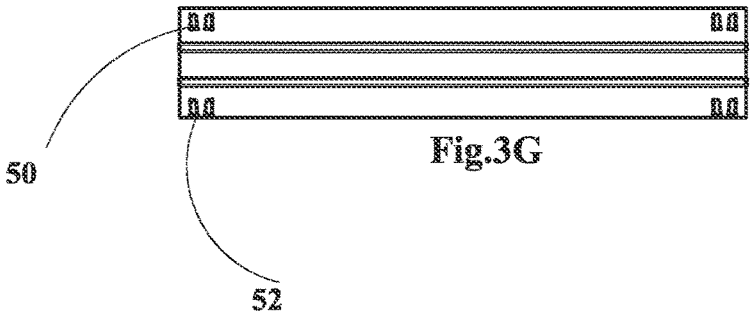
FIG. 3G is a broadside view of fasteners of a beam.
Figure 3H:
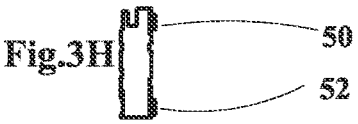
FIG. 3H is view of fasteners of a beam.
Figure 3F:
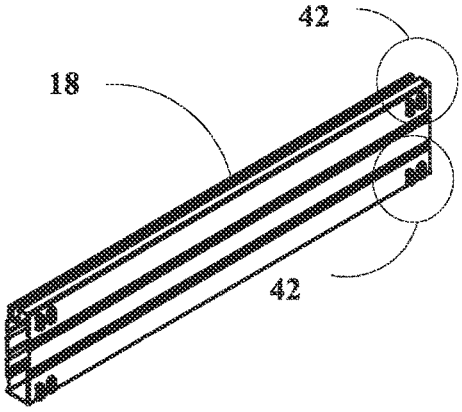
FIG. 3F is a perspective view of fasteners groups of a beam.

In FIG. 3A the broad side of horizontal beam 18 is shown, featuring on both extremes fastener group 42. Looking from the narrow side of beam 18, at FIG. 3B the two groups of fasteners 42 can be seen extending from the otherwise flat surface of the beam. In FIG. 3C the beam 18 is shown with the fasteners. All the fasteners extend from the same surface as can be seen in FIG. 3D an enlarged view of one group of fasteners at the extremity of horizontal beam. Thus, there are two horizontally arranged doublets of fasteners including on the upper side fasteners 50 and on the lower side fasteners 52. The two doubles are identical and can be simultaneously fit inside two doublets of perforations as described above with reference to FIG. 2B. The positioning of the fasteners with respect to the horizontal beam and the profile from which it is made are described more clearly in the enlarged view demonstrated in FIG. 3D. In FIG. 3E some features of the fasteners are shown and discussed following.

Fasteners, Structural Aspects Thereof, Interaction with the Upright Post and the Gamma Perforations in Particular As demonstrated in FIG. 3E Fastener 52A has recess 56 at one side, and a frontal cover 58. The interaction of the fastener 52 (for the sake of clarity the post is not shown) with upright post 16 is explained with reference to FIGS. 4A-5B.

Figure 4A:
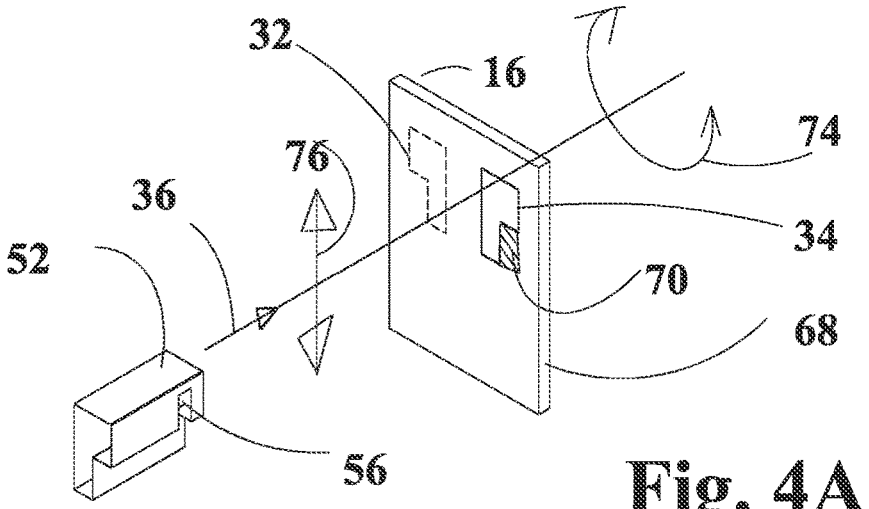
FIG. 4A is an enlarged isometric view of the fastener interaction with the gamma perforation.
Figure 4B:
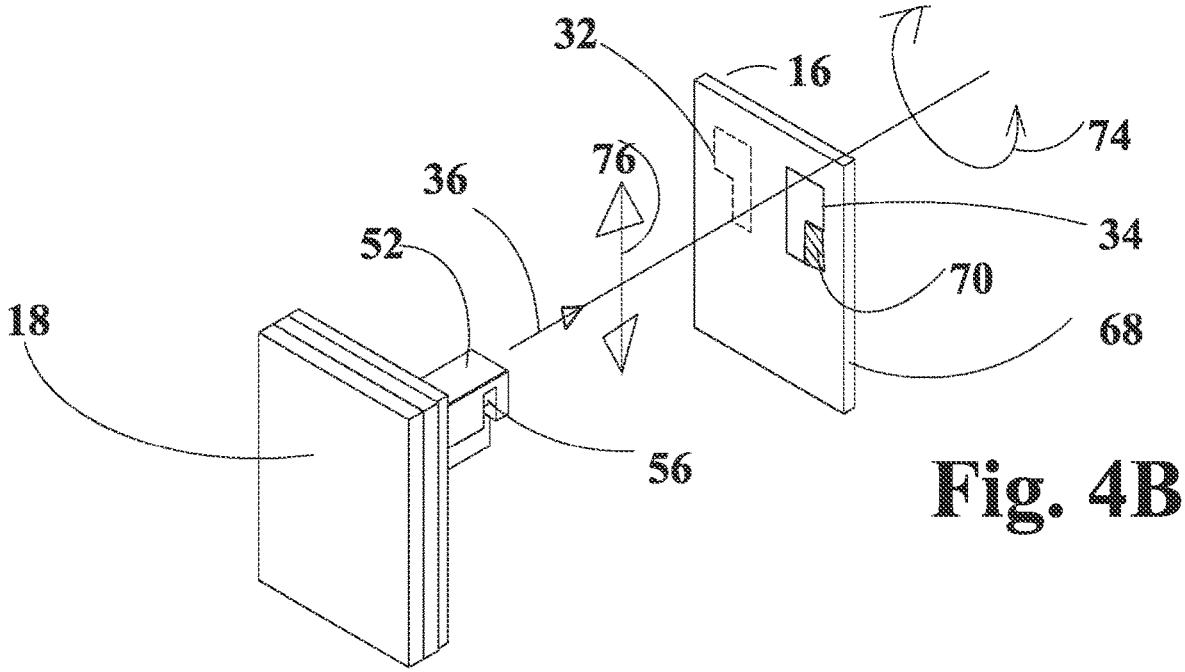
FIG. 4B is an enlarged isometric view of the fastener interaction with the gamma perforation showing more detail.

In FIGS. 4A and B, upright post 16 features two chirally arranged perforations. 32 and 34, the rest of the discussion below deals with perforation 34 in more detail. Fastener 52 points at a matching perforation 34 (arrow 36) and when poked at the perforation, cross recess 56 gets aligned with the width dimension 68 of upright post 16 this alignment allows fastener 52 to be pushed down while being inserted in the perforation 34, so that metal projection 70 (shown hatched) is entangled within recess 56. Thus, in order to implement the construction fastening of the invention, several movements are to be executed sequentially, as follows. First fastener 52 is poked into a matching gamma perforation 34, (in the direction of arrow 36) then the fastener is lowered (pushed down) in the direction of double headed arrow 76 (lower part) optionally forcefully, this is also the direction of gravity pull. As a result, fastener 52 becomes engaged with upright post 16. The tenacity and stability of the link between the width forming post not shown, but the manner by which the fastener is attached prevents swivelling of the fastener 52 in the direction as described by double headed arrow 74 (around axis—arrow 36) because it is a rectangular box restrained by the sides (broad and narrow) of gamma perforation 34. Up and down movement as indicated by double headed arrow 76 is restrained by the top and bottom walls of the gamma perforation. The engagement of fastener 52 with metal flap 70 prevents undesirable detachment of the fastener from the upright post 16. Thus, in order to intentionally detach the fastener from post 16 it will have to be lifted up against gravity force (arrow 76) thereby detaching from flap 70. This alludes to the fact that gravity is harnessed in this connection to the stabilization of the structure of the connection once established. At this point the fact that the entire discussion of the procedure to achieve the connection of the fastener with the upright post has been conducted in the singular, the actual performance in accordance with the present invention, dictates two connections being executed at once with the two chiral perforations 32 and 34 made simultaneously, thereby providing extra strength to the connection yet allowing for thin profile walls. of both vertical and width forming frame parts to be thinned (typically by the process of rolling). Moreover, according to a preferred embodiment of the invention two doublets of fasteners are employed at once, with each such connection (see FIG. 3D and FIGS. 7A-C), thereby providing additional stability parameters to the connection. Another structural feature of the fastener is explained with reference to FIGS. 5A-C. Fastener 52 is shown as it confronts the gamma perforation with which it is engageable explicitly demonstrating the role of leg 86, the front face 88 of which is shown hatched, recess 90 in leg 86 is optional.

Figure 5A:
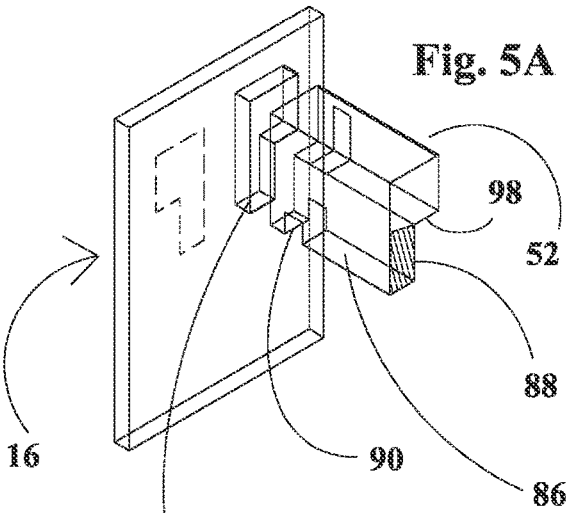
FIG. 5A is a schematic isometric view of the fastener and perforation engaging mechanism in accordance with the present invention.
Figure 5B:
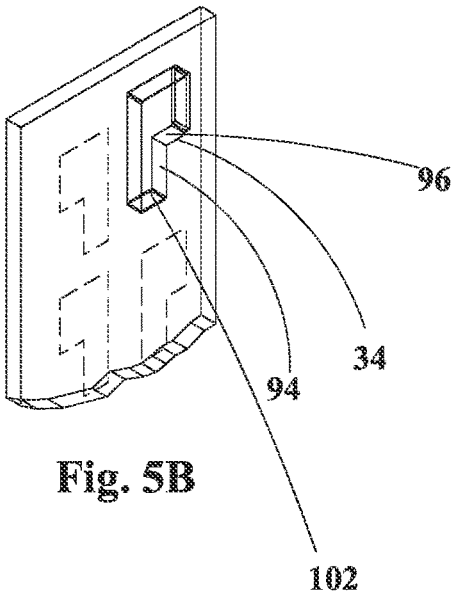
FIG. 5B is a schematic isometric view of perforation for the engaging mechanism in accordance with the present invention.
Figure 5C:
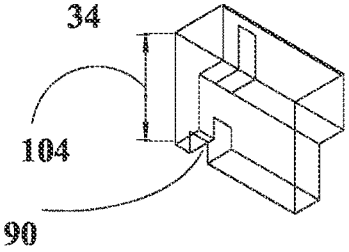
FIG. 5C illustrates the vertical length of a fastener.

The depth of the recess 90 up the leg 86 can limit the extent to which the fastener 52 can be pushed downwards when inserted inside perforation 34. As can be seen in FIG. 5B walls 94 of perforation 34 constrain the swivelling of fastener 52 and can guard against undesirable collapse of the entire structure of an erected rack in a direction parallel to post 16. In addition, inner face 96 of perforation 34 also constrains a potential swivelling of fastener 52 by abutting face 98 of fastener 52. As regards the length of leg 86, or in other words the length vertical length 104 (in FIG. 5C) or the reach of fastener 52 downwards inside perforation 34, there are several options, in some embodiments, leg 86 does not reach horizontal lowermost surface 102 of the perforation, in which case there is no reason for forming recess 90 at all in which case the fastener 52 would look as described in FIG. 4A. In other embodiments the fastener may just reach the bottom of the perforation when it is pressed downwards, and in yet other embodiments as can be seen in FIG. 5C it is longer and may reach beyond the bottom of the perforation while it is pressed downwards, if recess 90 exists and in such a case recess 90 is functional.

The Profiles of the Posts and Beams

Figure 6:
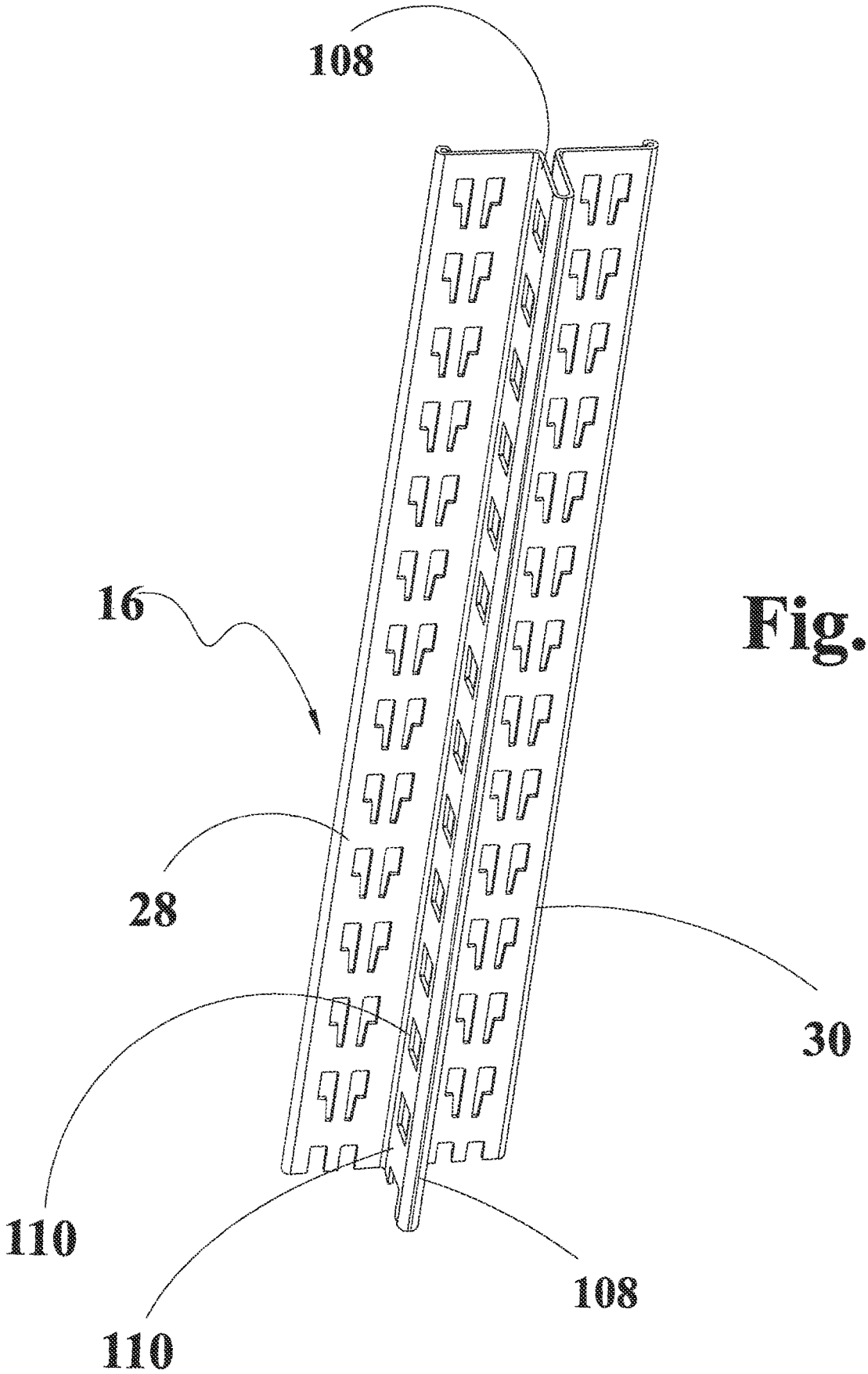
FIG. 6 illustrates an upright non voluminous post in accordance with the present invention having two types of perforations.

In an aspect of the invention, in order to save on weight while maximizing the stability and strength of the connection, the voluminous profiles of the horizontal width forming beams are made with thin walls. Typically, the upright posts are not voluminous, and are referred to hereinafter as NV posts. As can be seen in FIG. 6 NV post 16 features two flanks, 28 and 30, respectively, rib 108, perpendicular to the plain formed by flanks 28 and 30, features a columnar string of perforations 110, these perforations on rib 108 are rectangular or even square cut-outs in the rib. Thus, making the rib engageable with width forming beams. These perforations serve to receive the matching fastener in the extremity of depth forming beams 20 (see FIG. 1, not shown in FIG. 6).

Figure 7A:
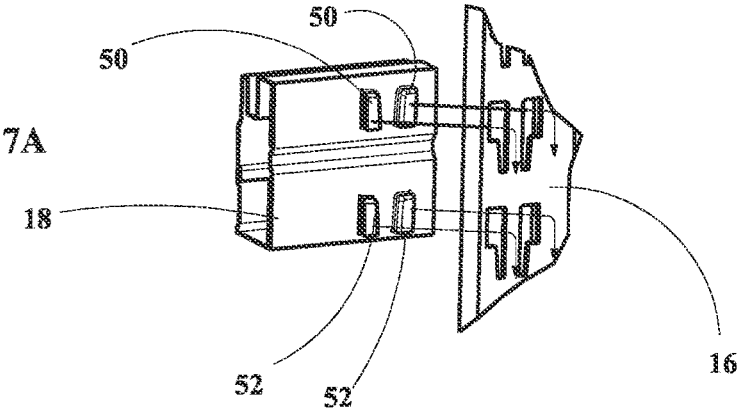
FIG. 7A depicts, pictorially, fasteners and matching perforations.
Figure 7C:
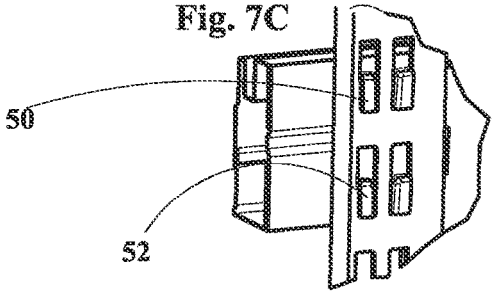
FIG. 7C depicts, pictorially, resting fasteners in matching perforations.
Figure 7B:
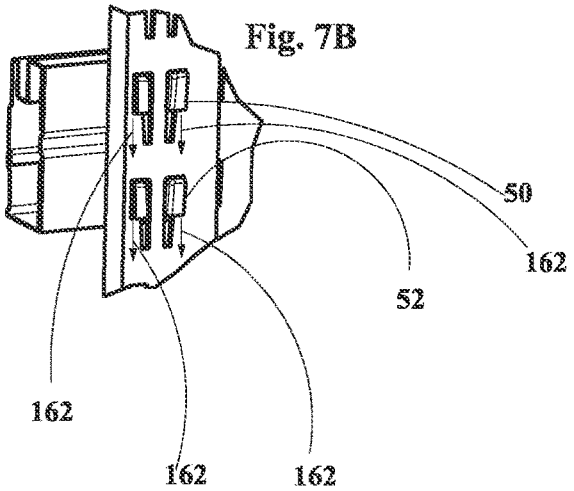
FIG. 7B depicts, pictorially, poking fasteners into matching perforations.

Pictorial Demonstration of the Width Forming Beams with the Upright Posts and Matching Perforations In FIGS. 7A-C the insertion of the fasteners is shown in the order of steps executed. Thus, in FIG. 7A horizontal beam 18 bears two fasteners 50 (on the upper side and two fasteners 52 on the lower side. To make the connection, all the fasteners are poked at once inside the selected perforations in the upright beam 16, as seen in FIG. 7B. Then the horizontal beam 18 is pushed downwards in the direction of arrows 162. In FIG. 7C the fasteners upper and lower are seen in their respective perforations resting at the bottom most position within the respective perforations.

Exemplary Illustration of a Beam with a Thickened Wall Portion

Figure 8A:
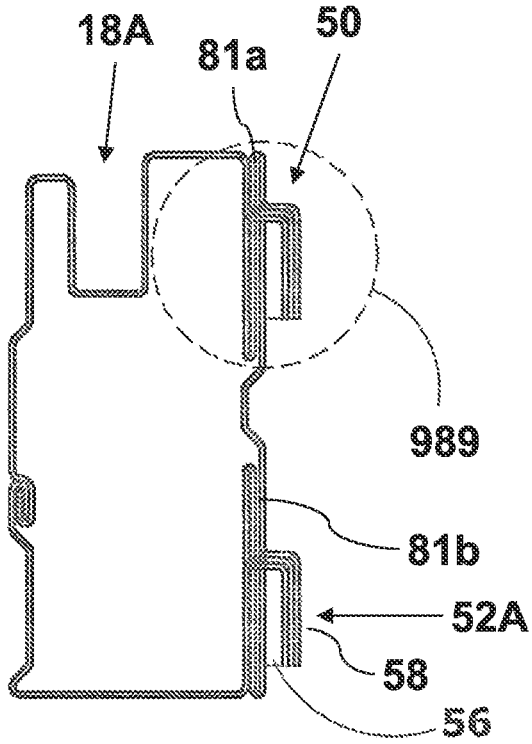
FIG. 8A is end on view of beam in accordance with an embodiment of the current invention.
Figure 8B:
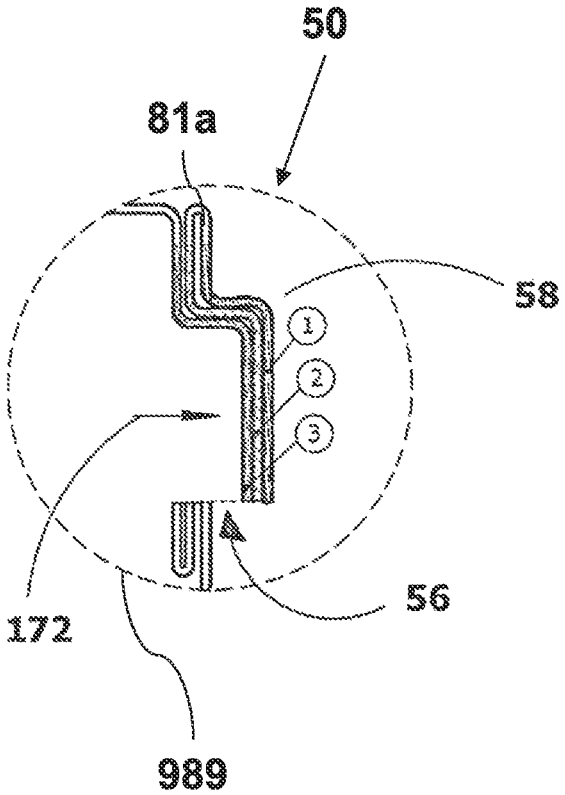
FIG. 8B is an enlarged cross-sectional view of a beam cut across a recess and cover of a fastener in accordance with an embodiment of the current invention.

FIG. 8A is end on view of beam 18A having a recess and cover 58 of fasteners 50 and 52 in accordance with an embodiment of the current invention and FIG. 8B is an enlarged cross-sectional view of a beam 18A cut across recess 56 and cover 58 of fastener 50 in accordance with an embodiment of the current invention. In some embodiments, a portion 81*a*, 81*b* wall of a beam having a connection fitting (for example the upper portion 81*a* of the wall of beam 18A including fastener 52A and the lower portion 81*a* of the wall of beam 18A including fastener 52) may be thicker than other portions of the wall of the beam. In some embodiments, the beam 18A, and/or a post may be made of a sheet metal. Optionally, a thickened portion 81*a*, 81*b* of the sheet may be made by folding over and back to produce a portion 81*a* having 3 layers (e.g., layers 1, 2 and 3 marked on the drawing). For example, there may be 3, 5 and/or any odd number of layers. Alternatively or additionally, there may be 2, and/or 4 and/or an even number of layers. Optionally, a fastener 50, 52A is punched out of the thickened portion. Alternatively or additionally, the sheet including the thickened portions 81*a*, 81*b* and fasteners 50, 52A is then rolled and/or folded to form a beam and/or post. Alternatively or additionally, the sheet may be rolled and/or folded to form a beam 18A and/or post with thickened portions 81*a*, 81*b* and then the fasteners 50, 52A may be punched out.

Figure 9A:
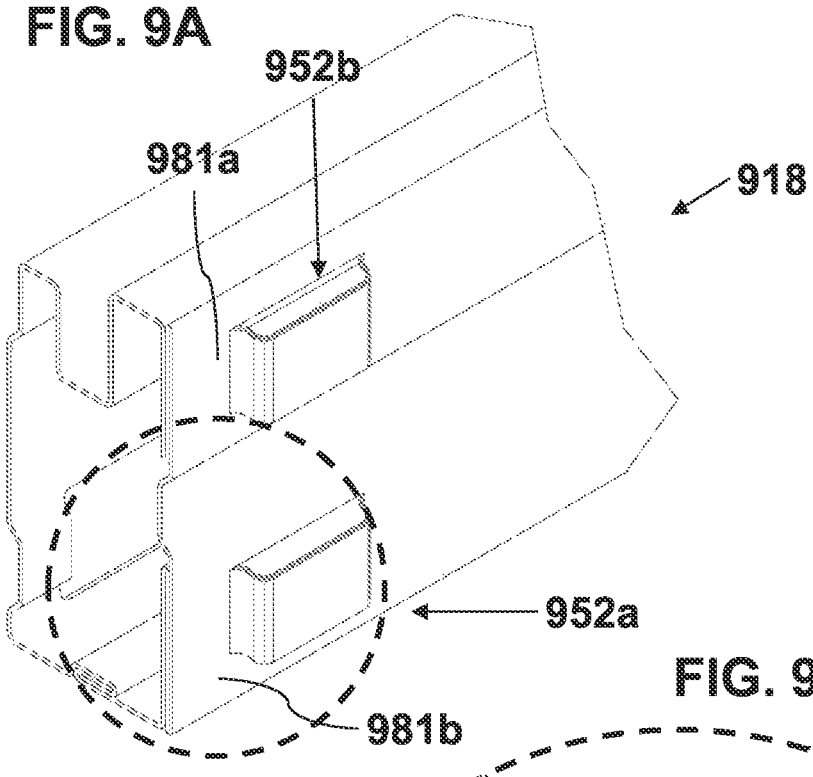
FIG. 9A is end on view of beam having punched out loops in accordance with an embodiment of the current invention.
Figure 9B:
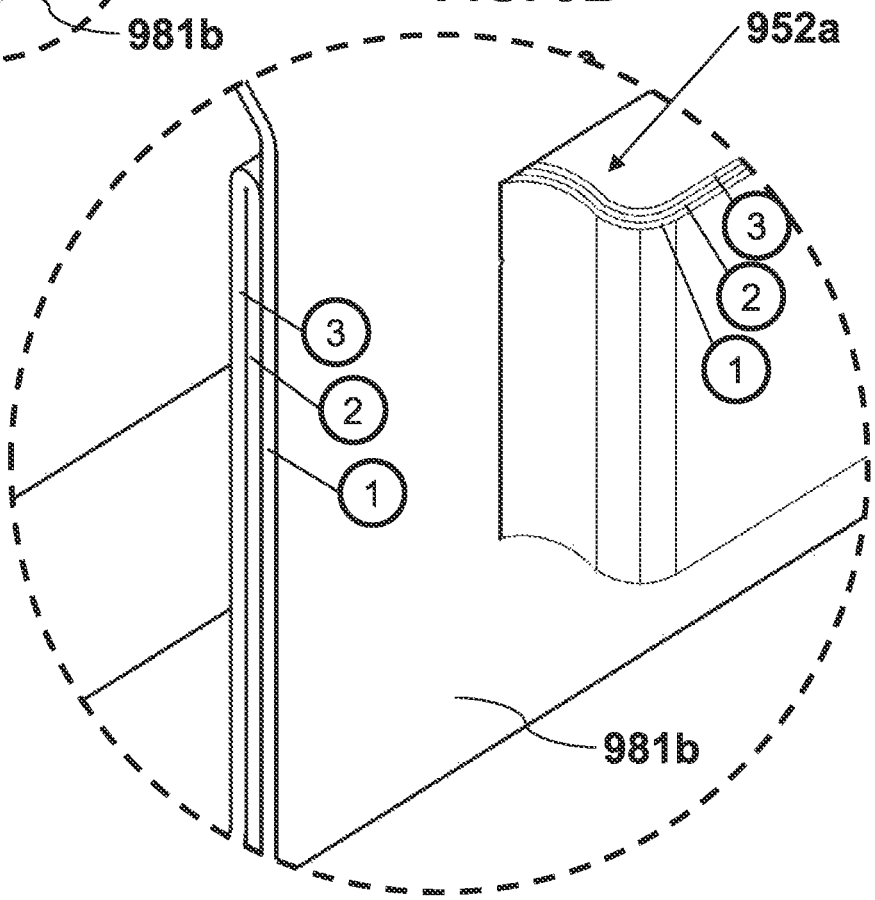
FIG. 9B is an enlarged cross-sectional view of a beam cut across a loop in accordance with an embodiment of the current invention

FIG. 9A is end on view of beam 918 having punched out loops 952*a*, 952*b* in accordance with an embodiment of the current invention. FIG. 9B is an enlarged cross-sectional view of beam 918 cut across a loop 952*a* in accordance with an embodiment of the current invention. In some embodiments, a portion 981*a*, 981*b* wall of a beam 918 having a connection fitting (for example the upper portion 981*a* of the wall of beam 918 includes a loop fastener 952*b* and the lower portion 981*b* of the wall of beam 918 including fastener 952*a*) may be thicker than other portions of the wall of the beam 918. In some embodiments, the beam 918, and/or a post may be made of a sheet of metal. Optionally, a thickened portion 981*a*, 981*b* of the sheet may be made by folding over and back to produce a portion 981*a* having 3 layers (e.g., layers 1, 2 and 3 marked on the FIG. 9B). For example, there may be 3, 5 and/or any odd number of layers. Alternatively or additionally, there may be 2, and/or 4 and/or an even number of layers. Optionally, a fastener 952*a*, 952*b* is punched out of the thickened portion 981*b*, 981*a*. Alternatively or additionally, the sheet including the thickened portions 981*a*, 981*b* and fasteners 952*a*, 952*a* is then rolled and/or folded to form a beam and/or post. Alternatively or additionally, the sheet may be rolled and/or folded to form a beam 918 and/or post with thickened portions 911*a*, 81*b* and then the fasteners 952*a*, 952*b* may be punched out. For example, beam 918 may be attached to an upright post having upward facing hooks (e.g., similar to fasteners 52 with the recess 56 facing upward).

In some embodiments, the upright post may be made with a thickened wall (e.g., made by folding a metal sheet back and forth) and/or the fasteners (e.g., hooks) could be punched out of the thickened part of the walls). The post may be non-voluminous.

Figure 10:
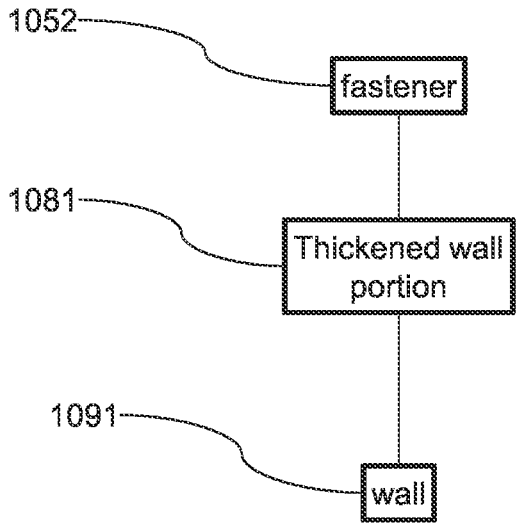
FIG. 10 is block diagram of a bar with a thickened wall portion and fastener in accordance with an embodiment of the current invention.
Figure 11:
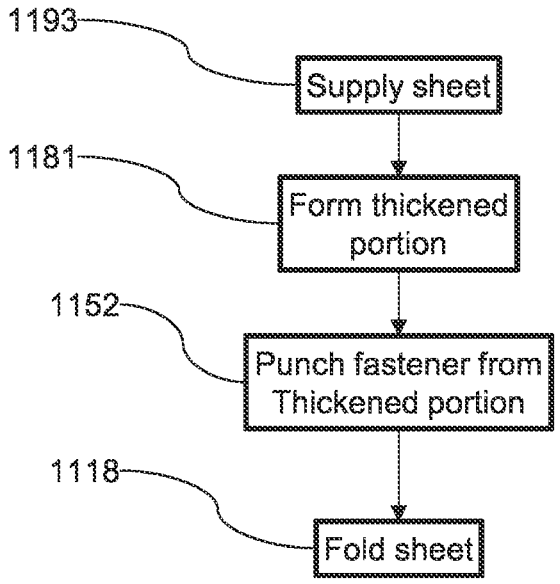
FIG. 11 is flow illustrating forming of a bar with a thickened wall portion and fastener in accordance with an embodiment of the current invention.

FIG. 10 is block diagram of a bar with a thickened wall portion and fastener in accordance with an embodiment of the current invention. In some embodiments, a bar is made from a sheet of metal. Optionally, the sheet of metal may form walls 1091 of the bar. Optionally, a portion 1081 of the sheet and/or walls 1091 of the bar is made thicker (e.g., includes multiple layers of metal for example, by folding and folding back the metal). Optionally, the sheet is folded to form a bar (for example, the sheet may be folded into a hollow bar with a rectangular cross section and/or the sheet may be folded into a non-volumous bar (e.g., a T cross-section and/or an I beam)). In some embodiments, the folds that form the bar are parallel to the folds that form the thickened portion 1081. For example, the thickened portion 1081 may extend the entire length of the bar. Optionally, fasteners 1052 (e.g., hooks and/or loops) may be punched out of the sheet and/or walls 1091 of the bar. The bar may optionally be used as an upright post and/or a horizontal (e.g., width forming 0 FIG. 11 is flow illustrating forming of a bar with a thickened wall portion and fastener in accordance with an embodiment of the current invention. In some embodiments, a bar is made from a sheet of metal. Optionally, the sheet of metal is supplied 1193 to form walls of the bar. Optionally, a portion of the sheet and/or walls of the bar is made thicker 1181 (e.g., includes multiple layers of metal for example, by folding over and folding back the metal). Optionally, the sheet is folded 1118 to form a bar (for example, the sheet may be folded 1118 into a hollow bar with a rectangular cross section and/or the sheet may be folded 1118 into a non-volumous bar (e.g., a T cross-section and/or an I beam)). For example, folds may be back over each other to form the non-volumous cross-section. In some embodiments, the folds that form the bar are parallel to the folds that form the thickened portion. For example, the thickened portion may extend the entire length of the bar. Optionally, fasteners (e.g., hooks and/or loops) may be punched 1152 out of the sheet and/or walls of the bar. The bar may optionally be used as an upright post and/or a horizontal (e.g., width forming and/or depth forming) beam.

It is expected that during the life of a patent maturing from this application many relevant technologies will be developed and the scope of the term is intended to include all such new technologies a priori.

As used herein the term "about" refers to 10%

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween. When multiple ranges are listed for a single variable, a combination of the ranges is also included (for example the ranges from 1 to 2 and/or from 2 to 4 also includes the combined range from 1 to 4).

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A bar comprising:

a wall on at least one side of the bar and including a thinner portion running an entire length of the wall and a thicker portion running the entire length of the wall, said thicker portion being thicker than said thinner portion; and a fastener punched out from said thicker portion, wherein the bar is hollow and wherein said wall at a location of said fastener is a wall of a hollow of the bar;

wherein said thicker portion includes multiple layers of metal folded against each other;

wherein said thicker portion includes an odd number of layers.

2. The bar of claim 1, wherein said wall is formed of a single sheet of folded metal.

3. The bar of claim 1, wherein said fasteners include at least one of a hook and a loop.

4. A storage rack comprising:

a bar including:

a wall forming at least one side of the bar and including a thin portion running an entire length of the wall and a thickened portion running the entire length of the wall, the thickened portion being thicker than a thinner portion of the wall; and a fastener formed in said thickened portion, wherein the bar is hollow and wherein at a location of said fastener said wall is a wall of a hollow of the bar wherein the bar is configured to be positioned horizontally for use as a horizontal beam of the rack and said fastener connects the horizontal beam to an upright post of the rack.

5. The storage rack of claim 4, wherein said thickened portion includes multiple layers of metal folded against each other.

6. The storage rack of claim 4, wherein said wall is formed of a single sheet of folded metal.

7. The storage rack of claim 4, wherein said fasteners include at least one of a hook and a loop.

8. A method of making a bar comprising:

supplying a sheet of metal;

folding over a portion of the sheet onto itself to form a thickened portion of multiple layers along a full length of the sheet;

punching a fastener out of said thickened portion; and further folding the sheet into a bar with said thickened portion running a full length of the bar and said fastener in a wall of the bar, wherein said further folding the sheet into a bar include at least two folds to form a hollow bar with said thickened portion and said fastener in a wall of a hollow of the bar.

9. The method of claim 8, wherein said folding over a portion includes folding back and forth to form a line of multilayered material.

10. The method of claim 8, wherein said further folding the sheet into a bar includes at least two folds to form a hollow cylinder of non-circular cross section.

11. The method of claim 8, wherein said folding over and said further folding the sheet are along parallel folds.

12. The method of claim 8, wherein the bar is a positioned horizontally for use as a horizontal beam of a rack and said fastener connects the horizontal beam to an upright post of the rack.

13. A storage rack comprising:

a bar including:

a wall forming at least one side of the bar and including a thin portion running an entire length of the wall and a thickened portion running the entire length of the wall, the thickened portion being thicker than a thinner portion of the wall; and a fastener formed in said thickened portion, wherein the bar is hollow and wherein at a location of said fastener said wall is a wall of a hollow of the bar;

wherein said thickened portion includes multiple layers of metal folded against each other;

wherein said thicker portion includes an odd number of layers.

14. The storage rack of claim 13, wherein said wall is formed of a single sheet of folded metal.

15. The storage rack of claim 13, wherein said fasteners include at least one of a hook and a loop.

* * * * *